US009614289B2

(12) United States Patent
Asai

(10) Patent No.: US 9,614,289 B2
(45) Date of Patent: Apr. 4, 2017

(54) METAMATERIAL

(71) Applicant: CANON KABUSHIKI KAISHA, Tokyo (JP)

(72) Inventor: Hitoshi Asai, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 119 days.

(21) Appl. No.: 14/426,035

(22) PCT Filed: Aug. 29, 2013

(86) PCT No.: PCT/JP2013/073855
§ 371 (c)(1),
(2) Date: Mar. 4, 2015

(87) PCT Pub. No.: WO2014/050477
PCT Pub. Date: Apr. 3, 2014

(65) Prior Publication Data

US 2015/0236427 A1 Aug. 20, 2015

(30) Foreign Application Priority Data

Sep. 25, 2012 (JP) ..... 2012-211533

(51) Int. Cl.
*H01Q 15/00* (2006.01)
*H01Q 1/52* (2006.01)

(52) U.S. Cl.
CPC ..... *H01Q 15/006* (2013.01); *H01Q 1/52* (2013.01)

(58) Field of Classification Search
CPC ..... H01Q 15/006; H01Q 1/52
See application file for complete search history.

(56) References Cited

U.S. PATENT DOCUMENTS

| | | | | |
|---|---|---|---|---|
| 6,262,495 | B1 | 7/2001 | Yablonovitch et al. | |
| 7,760,154 | B2 | 7/2010 | Sekine et al. | |
| 8,368,488 | B2 | 2/2013 | Kim et al. | |
| 8,743,017 | B2 | 6/2014 | Toujo | |
| 2009/0071709 | A1* | 3/2009 | Han | H05K 1/0236 174/360 |
| 2011/0090918 | A1 | 4/2011 | Umehara et al. | |

(Continued)

FOREIGN PATENT DOCUMENTS

| | | | |
|---|---|---|---|
| JP | 2002-510886 | A | 4/2002 |
| JP | 2004-207746 | A | 7/2004 |

(Continued)

OTHER PUBLICATIONS

Japanese Office Action dated May 6, 2016 in Japanese Application No. 2012-211533.

*Primary Examiner* — Hoang V Nguyen
*Assistant Examiner* — Michael Bouizza
(74) *Attorney, Agent, or Firm* — Fitzpatrick, Cella, Harper & Scinto

(57) ABSTRACT

A cell forming a metamaterial, comprises a patch conductor, a conductor layer arranged in parallel with the patch conductor, and a connection conductor configured to electrically connect the patch conductor and the conductor layer. The connection conductor forms a helical electrical path by a plurality of conductor lines and a plurality of vias which connect the conductor lines to the patch conductor and the conductor layer.

12 Claims, 19 Drawing Sheets

(56) References Cited

U.S. PATENT DOCUMENTS

| | | | | |
|---|---|---|---|---|
| 2011/0139488 | A1* | 6/2011 | Toujo ..... | H01P 3/081<br>174/126.1 |
| 2011/0163826 | A1 | 7/2011 | Toujo | |

FOREIGN PATENT DOCUMENTS

| | | | |
|---|---|---|---|
| JP | 2009-004779 | A | 1/2009 |
| JP | 2009-044556 | A | 2/2009 |
| JP | 2009-224567 | A | 10/2009 |
| JP | 2011-097334 | A | 5/2011 |
| WO | 99-50929 | A1 | 10/1999 |
| WO | 2010-026906 | A1 | 3/2010 |
| WO | 2010-026908 | A1 | 3/2010 |

* cited by examiner

METAMATERIAL

TECHNICAL FIELD

The present invention relates to a metamaterial to be mounted on a printed circuit board.

BACKGROUND ART

A metamaterial is an artificial material obtained by periodically arranging unit elements called cells and having electromagnetic characteristics not existing in the natural world. The metamaterial is applied to, for example, an electromagnetic bandgap structure, an antenna, and a lens having a negative flection ratio. The electromagnetic bandgap structure is a metamaterial having a specific frequency band (to be referred to as an electromagnetic bandgap hereinafter) that suppresses the propagation of electromagnetic waves. The electromagnetic bandgap structure having this electrical characteristic is applied to a band-stop filter, to suppress the mutual interference between antennas, and the like. Since the electromagnetic bandgap structure also functions as a magnetic wall, applications using this property are being examined. For example, Japanese Patent Laid-Open No. 2009-044556 has disclosed an antenna thinning technique of closely arranging a metal plate and antenna by using the electromagnetic bandgap structure.

A mushroom structure is a metamaterial to be mounted on a printed circuit board. The mushroom structure is a structure in which cells each obtained by connecting a conductor layer (generally, a ground layer or power supply layer) and a patch conductor by a connection conductor (generally, a single via) are periodically two-dimensionally arranged (for example, Japanese Patent Laid-Open No. 2002-510886). In the mushroom structure as shown in FIG. 1 of Japanese Patent Laid-Open No. 2002-510886, a series capacitor CL is formed between adjacent patch conductors, and a parallel inductor LL is formed by the connection conductor. These elements are the elements of a left-handed system. In addition, a series inductor LR is formed by the patch conductor, and a parallel capacitor CR is formed between the patch conductor and conductor layer. These elements are the elements of a right-handed system. A frequency between a parallel resonance frequency $\omega sh$ (=1/sqrt(LL×CR)) and series resonance frequency $\omega se$ (=1/sqrt(LR×CL)) is the electromagnetic bandgap. When the size of the cell is decreased, therefore, the series capacitor CL, parallel inductor LL, series inductor LR, and parallel capacitor CR generally also decrease, and the frequency of the electromagnetic bandgap rises. Accordingly, the conventional mushroom structure requires large cells in order to achieve a low-frequency-band electromagnetic bandgap. This makes it difficult to mount the mushroom structure on a printed circuit board, particularly, a small-sized, high-density printed circuit board.

Accordingly, a metamaterial (electromagnetic bandgap structure) that lowers the frequency of the electromagnetic bandgap by increasing the parallel inductance LL by the shape of the connection conductor has been proposed. For example, each of Japanese Patent Laid-Open Nos. 2009-004779 and 2009-224567 has disclosed a metamaterial in which the conductor length is increased by forming the connection conductor by connecting a plurality of vias and a plurality of conductor lines in series, thereby increasing the inductor of the connection conductor, that is, the parallel inductor LL.

Unfortunately, even the structures as described in Japanese Patent Laid-Open Nos. 2009-004779 and 2009-224567 are insufficient to meet the recent demands for high-density, small-sized packaging.

SUMMARY OF INVENTION

The present invention has been made in consideration of the abovementioned problem, and has as its object to provide a metamaterial cell that is small in size and achieves a low-frequency-band electromagnetic bandgap when compared to the conventional cells, by using a structure that efficiently increases the inductance of a connection conductor.

The present invention provides a cell forming a metamaterial, comprising a patch conductor, a conductor layer arranged in parallel with the patch conductor, and a connection conductor configured to electrically connect the patch conductor and the conductor layer, wherein the connection conductor forms a helical electrical path by a plurality of conductor lines and a plurality of vias which connect the conductor lines to the patch conductor and the conductor layer.

Further features of the present invention will become apparent from the following description of exemplary embodiments (with reference to the attached drawings).

DESCRIPTION OF EMBODIMENTS

Figure 1:
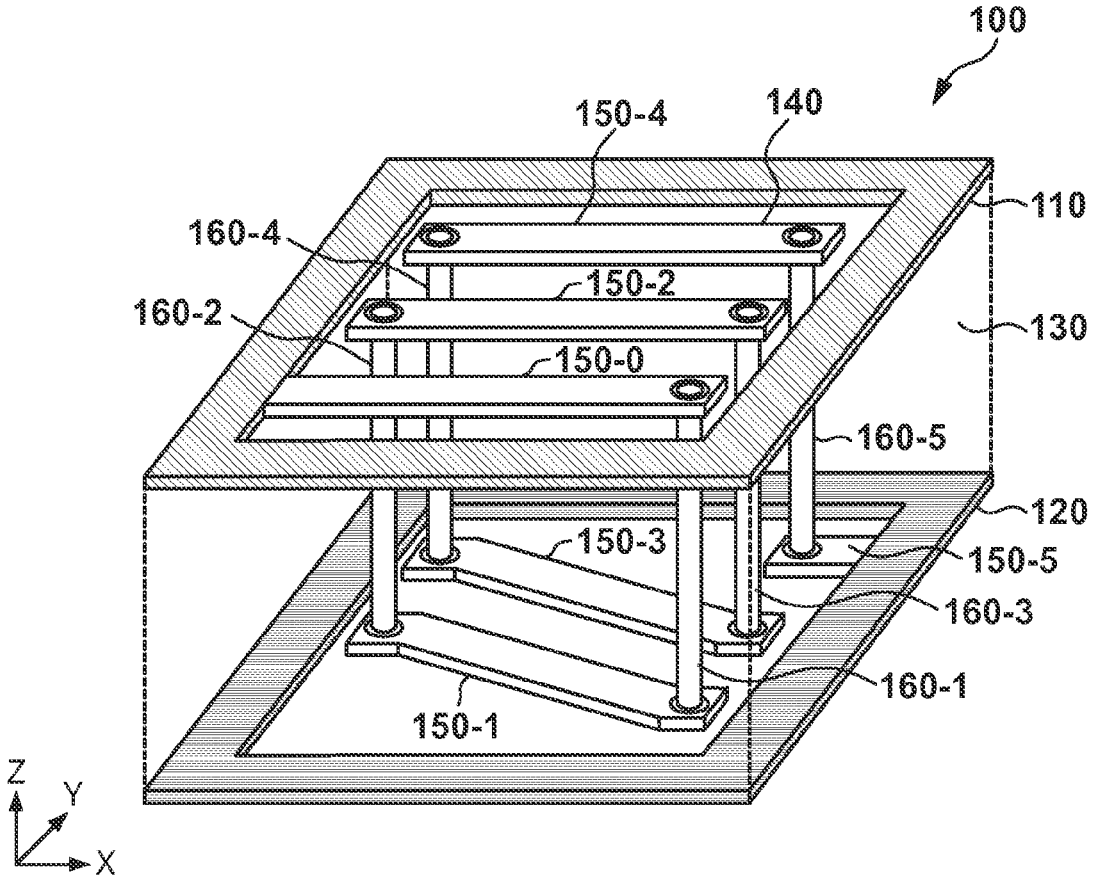
FIG. 1 is a three-dimensional perspective view of a metamaterial cell according to the first embodiment.

The inductance of a conductor is expressed by the sum of the self-inductance and the mutual inductance between the conductor and another conductor close to it. The self-inductance is determined by the shape of a conductor, and increases as the conductor length increases. The mutual inductance between conductors is obtained by Neumann's formula. For example, a mutual inductance M between conductors 1 and 2 is expressed by Neumann's formula as:

$$M = \frac{\mu}{4\pi}\oint_{C1}\oint_{C2}\frac{\overrightarrow{ds1}\cdot\overrightarrow{ds2}}{r} \quad (1)$$

where μ is the magnetic permeability, C1 is the path of integration extending along the shape of conductor 1, C2 is the path of integration extending along the shape of conductor 2, ds1 is the infinitesimal segment vector of conductor 1 (=the direction of an electric current flowing through conductor 1), ds2 is the infinitesimal segment vector of conductor 2, and r is the distance between conductors 1 and 2.

From equation (1), when directions (to be referred to as current directions hereinafter) in which electric currents flow through close conductors are a same direction, the mutual inductance is positive, and the inductances of the conductors increase. On the other hand, when the current directions are opposite, the mutual inductance is negative, and the inductances of the conductors decrease. In addition, the absolute value of the mutual inductance increases as the distance between the conductors reduces and the parallelism between them increases.

From the foregoing, to efficiently increase the inductance of a conductor, conductors having a same current direction are desirably arranged parallel and close to each other, and conductors having site current directions are desirably spaced apart from each other. Embodiments of the present invention will be explained below with reference to the accompanying drawings.

First Embodiment

Figure 2:
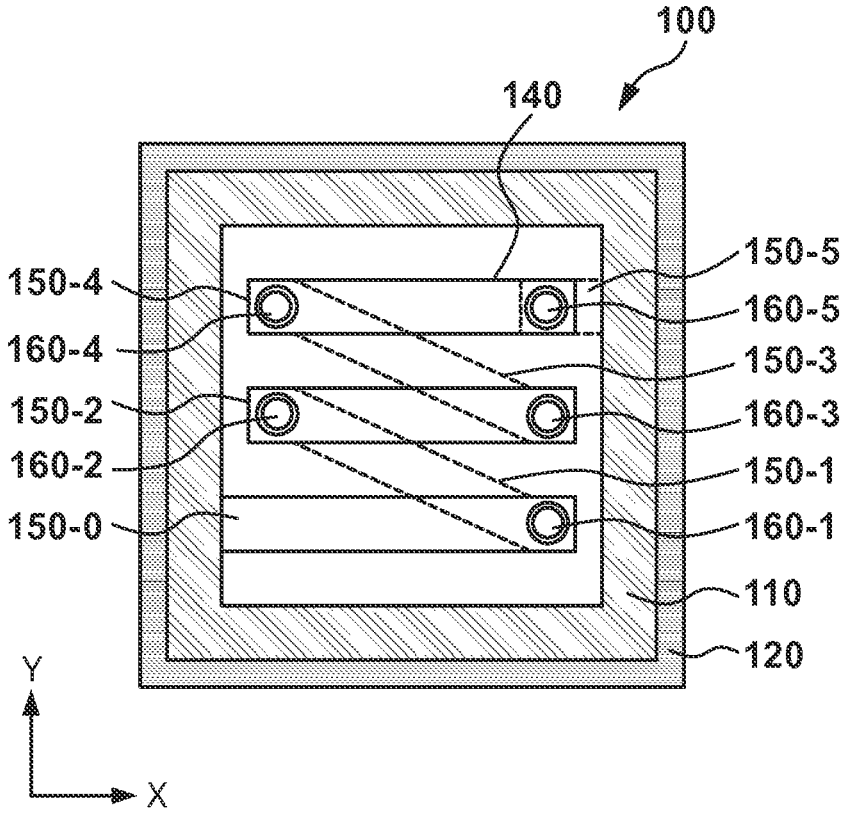
FIG. 2 is a plan view of the cell shown in FIG. 1.
Figure 3:
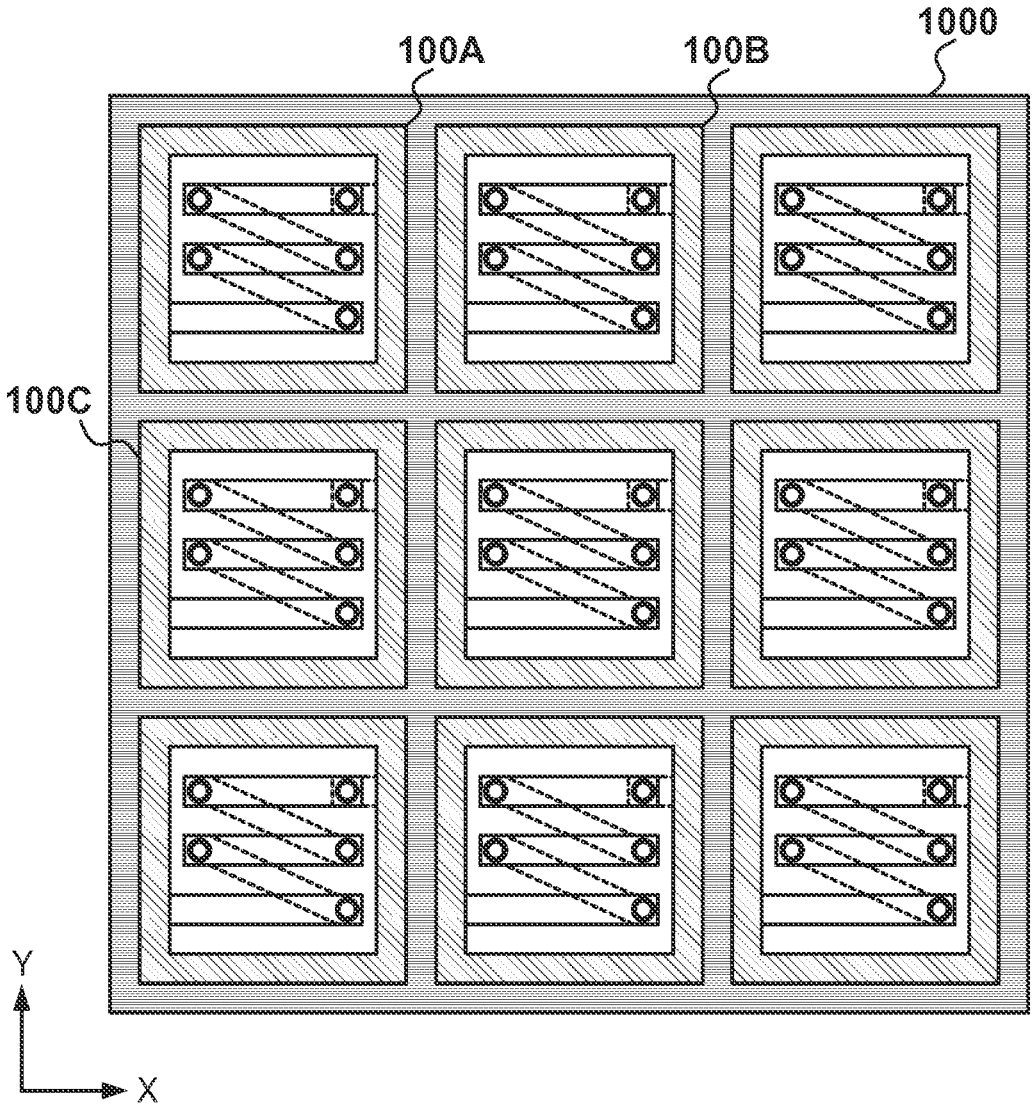
FIG. 3 is a view showing an example of the array structure of the cell shown in FIG. 1.

FIG. 1 is a three-dimensional perspective view of a metamaterial cell according to the first embodiment. FIG. 2 is a plan view of the cell shown in FIG. 1. FIG. 3 is a view showing an array structure example 1000 of the cell shown in FIG. 1. A cell 100 includes a patch conductor 110, a conductor layer 120, a dielectric layer 130, and a connection conductor 140 obtained by connecting conductor lines 150-0 to 150-5 and vias 160-1 to 160-5 in series. The patch conductor 110 and conductor layer 120 are arranged in parallel with each other. The via 160-1 is connected to the patch conductor 110 via the conductor line 150-0, and connected to the via 160-2 via the conductor line 150-1. Similarly, the vias 160-2 to 160-4 are respectively connected to the vias 160-3 to 160-5 via the conductor lines 150-2 to 150-4. The via 160-5 is connected to the conductor layer 120 via the conductor line 150-5. That is, the conductor lines are alternately arranged as they are connected to the vias. More specifically, the conductor lines 150-0, 150-2, and 150-4 are arranged parallel and close to each other, and the conductor lines 150-1 and 150-3 are also arranged parallel and close to each other. In this arrangement, an electrical path formed by the conductor lines and vias forms a helical type shape (a spiral shape in a three-dimensional space), as shown in FIG. 1.

In this embodiment, the conductor lines 150-0, 150-2, and 150-4 and patch conductor 110 are arranged on the same plane, and the patch conductor 110 has a clearance for containing the conductor lines 150-0, 150-2, and 150-4. Also, the conductor lines 150-1, 150-3, and 150-5 and conductor layer 120 are arranged on the same plane, and the conductor layer 120 has a clearance for containing the conductor lines 150-1, 150-3, and 150-5.

Assume that an electric current flows from the patch conductor 110 to the conductor layer 120. In this case, the electric current flows in the order of the conductor line 150-0, via 160-1, conductor line 150-1, via 160-2, conductor line 150-2, via 160-3, conductor line 150-3, via 160-4, conductor line 150-4, via 160-5, and conductor line 150-5. That is, the current directions are the same in the conductor lines 150-0, 150-2, and 150-4 arranged close to each other, and in the conductor lines 150-1 and 150-3 arranged close to each other. The current directions are also the same in the vias 160-1, 160-3, and 160-5, and in the vias 160-2 and 160-4. Therefore, the mutual inductances generated between these conductor lines and between these vias are positive, so the inductance of the connection conductor 140 increases.

As described above, the connection conductor 140 according to this embodiment has a helical type shape in which the conductor lines 150-1 to 150-5 and vias 160-1 to 160-5 are connected in series, and conductor lines having the same current direction are closely arranged. This shape makes it possible to efficiently increase the inductance of the connection conductor.

Note that the connection conductor 140 according to this embodiment is obtained by connecting the six conductor lines and five vias in series. That is, the connection conductor shown in FIG. 1 includes first to Nth vias (N is an integer of 3 or more), and at least first to (N+1)th conductor lines. The first via is connected to the patch conductor via the first conductor line, the Nth via is connected to the conductor layer via the (N+1)th conductor line, and the Kth via (K is any integer from 1 to N−1) is connected to the (K+1)th via via the (K+1)th conductor line. However, the numbers of conductor lines and vias are not limited to these numbers. The conductor lines and vias are desirably formed as thin as possible, and their numbers are desirably increased as much as possible, while the values of electric currents flowing through them and their resistance losses are taken into account, in order to obtain a large inductance in a narrow space. Also, capacitors are generated between closely arranged conductor lines and between closely arranged vias, and these capacitors contribute to an increase in parallel capacitance CR. That is, when the conductor lines and vias are arranged as closely as possible, it is possible to increase the parallel inductor LL and parallel capacitor CR, that is, decrease the frequency of the electromagnetic bandgap. On the other hand, the reduction in inductance can be suppressed when the vias 160-1, 160-3, and 160-5 and the vias 160-2 and 160-4 having current directions opposite to each other at 180° are spaced apart from each other as much as possible.

Figure 4:
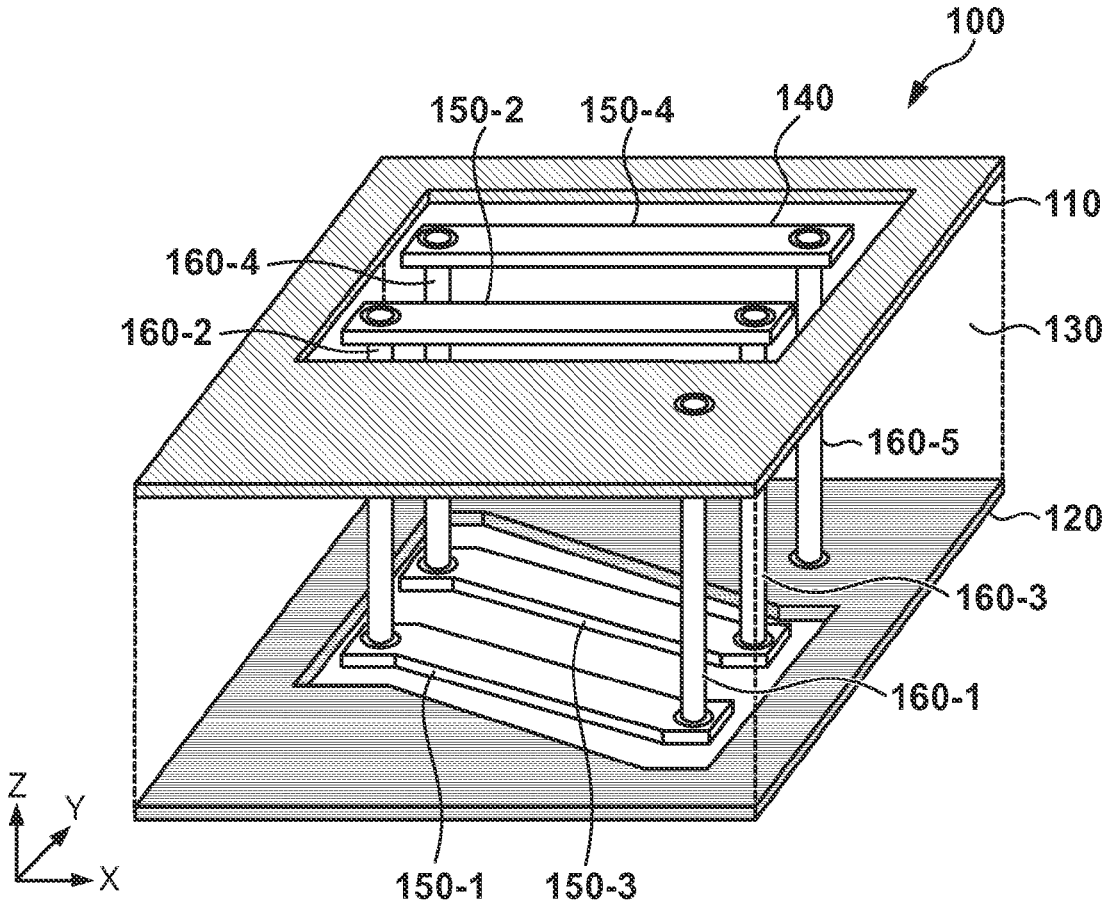
FIG. 4 is a three-dimensional perspective view of a metamaterial cell according to a modification of the first embodiment.

Also, in the connection conductor 140 according to this embodiment, the via 160-1 is connected to the patch conductor 110 via the conductor line 150-0. However, the present invention is not limited to this arrangement, and the via 160-1 can also be connected directly to the patch conductor 110, as shown in FIG. 4. Likewise, the via 160-5 can also be connected directly to the conductor layer 120, as shown in FIG. 4. That is, the connection conductor shown in FIG. 4 includes first to Nth vias (N is an integer of 3 or more), and first to (N−1)th conductor lines. The first via is directly connected to the patch conductor, the Nth via is directly connected to the conductor layer, and the Kth via (K is an integer of 1 to N−1) is connected to the (K+1)th via via the Kth conductor line.

Figure 5:
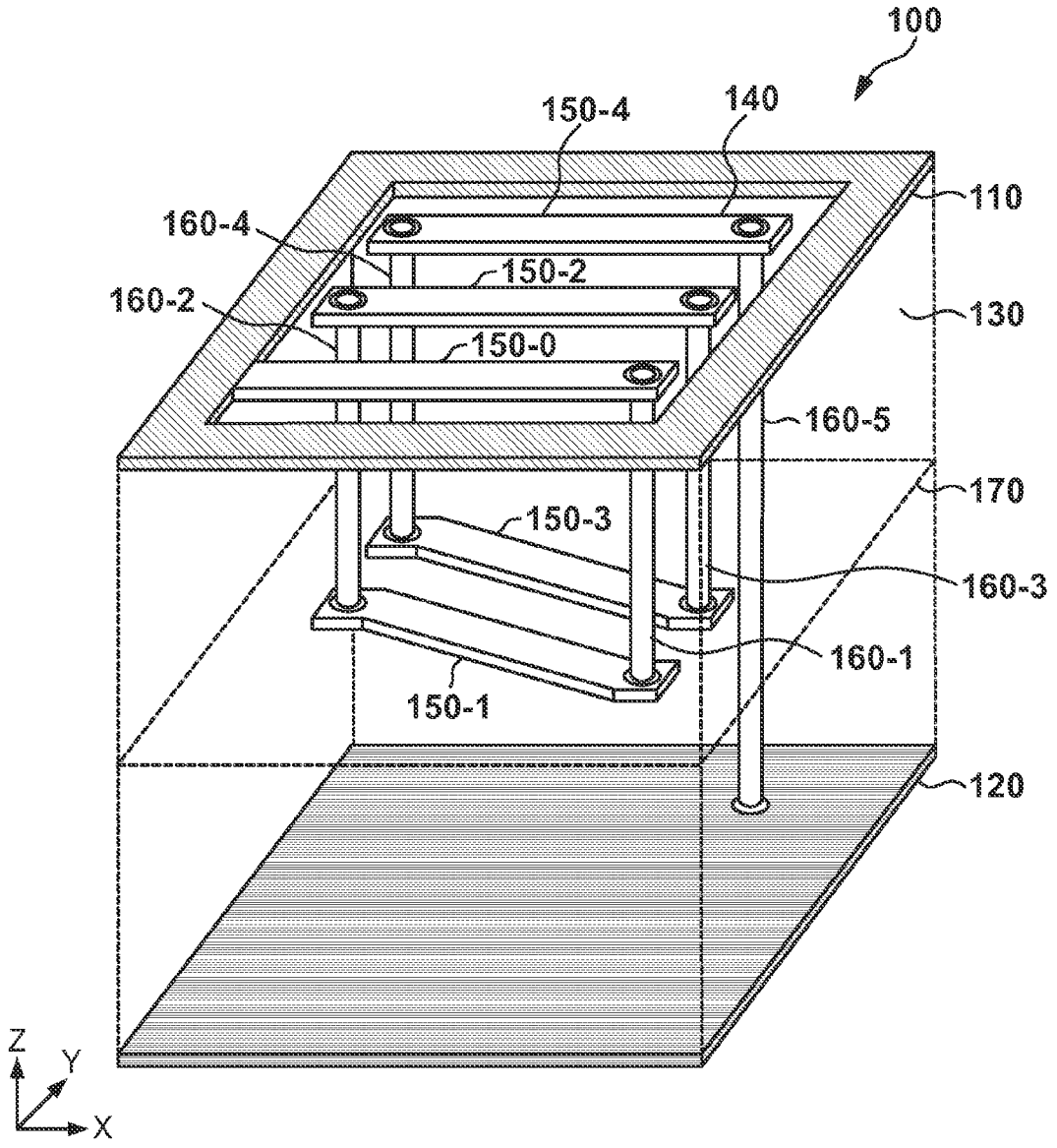
FIG. 5 is a three-dimensional perspective view of a metamaterial cell according to another modification of the first embodiment.
Figure 6:
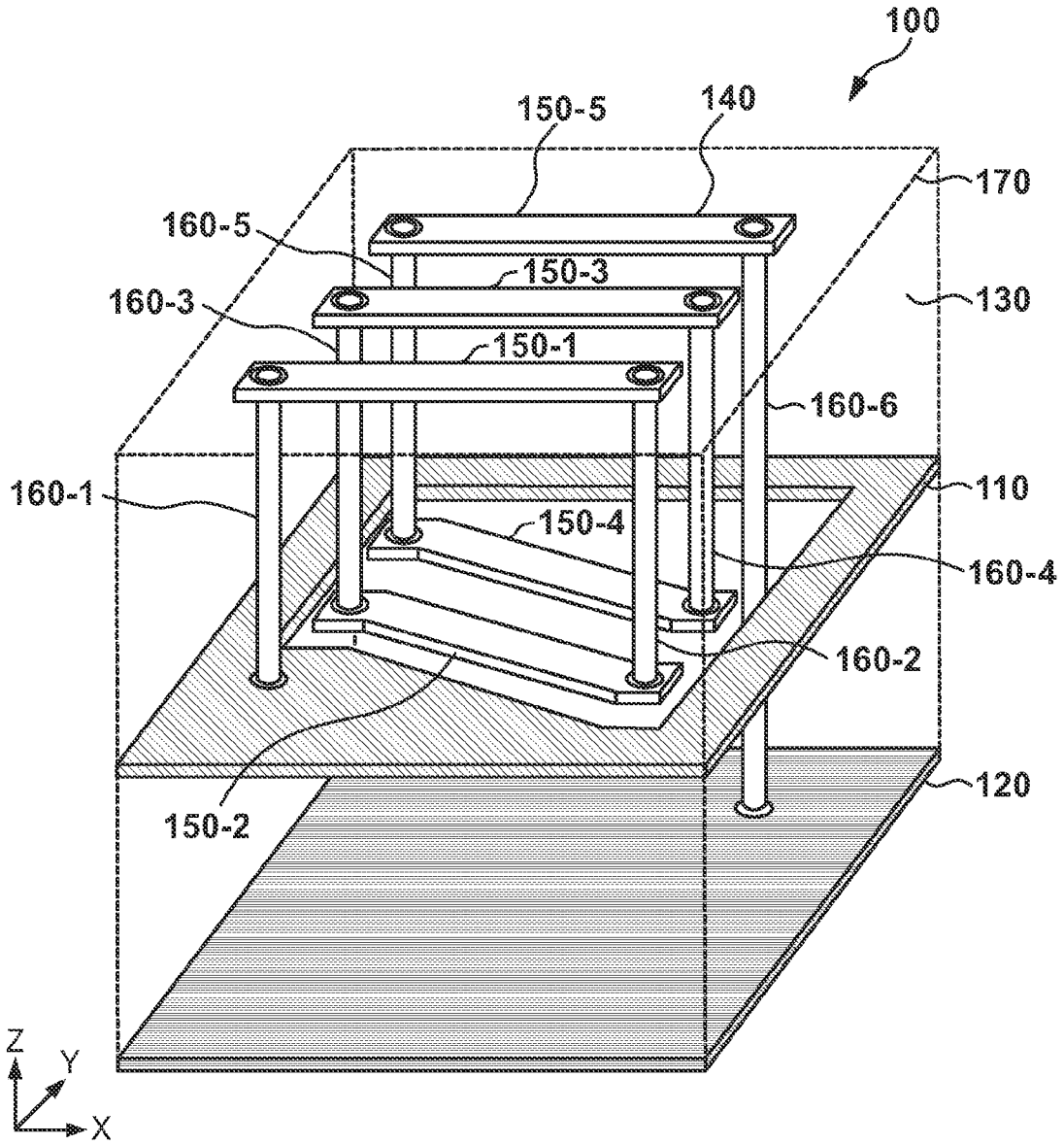
FIG. 6 is a three-dimensional perspective view of a metamaterial cell according to still another modification of the first embodiment.

Furthermore, in the connection conductor 140 according to this embodiment, the conductor lines 150-0, 150-2, and 150-4 and patch conductor 110 are formed on the same plane, and the conductor lines 150-1, 150-3, and 150-5 and conductor layer 120 are formed on the same plane. However, the present invention is not limited to this arrangement. For example, as shown in FIG. 5, the conductor lines 150-1 and 150-3 can also be formed on a plane 170 different from the conductor layer 120. In this arrangement, the clearance for containing the connection conductor can be excluded from the conductor layer 120. Also, the plane 170 can be formed not between the patch conductor 110 and conductor layer 120, but above the patch conductor 110, as shown in FIG. 6.

Figure 7:
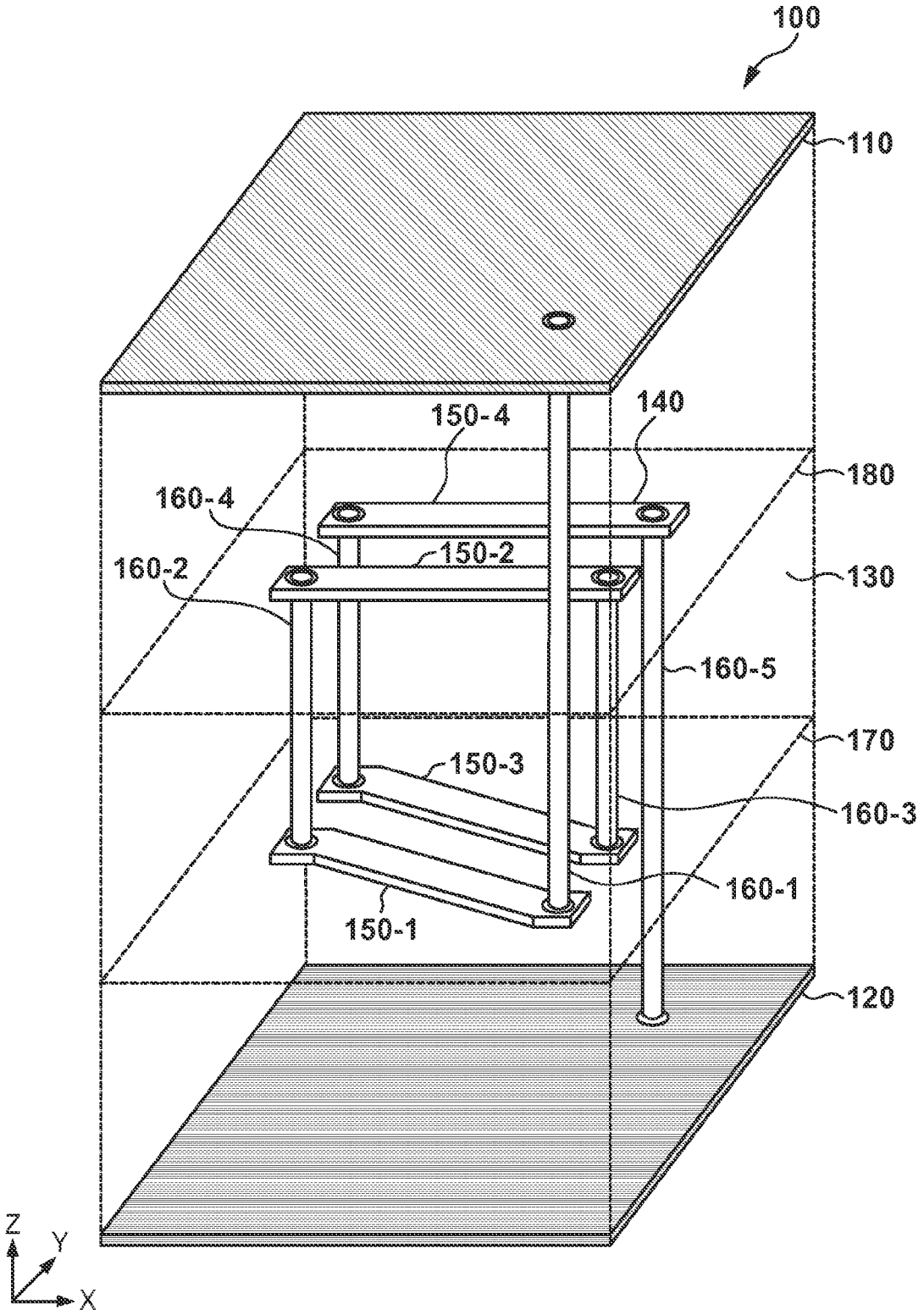
FIG. 7 is a three-dimensional perspective view of a metamaterial cell according to still another modification of the first embodiment.
Figure 8:
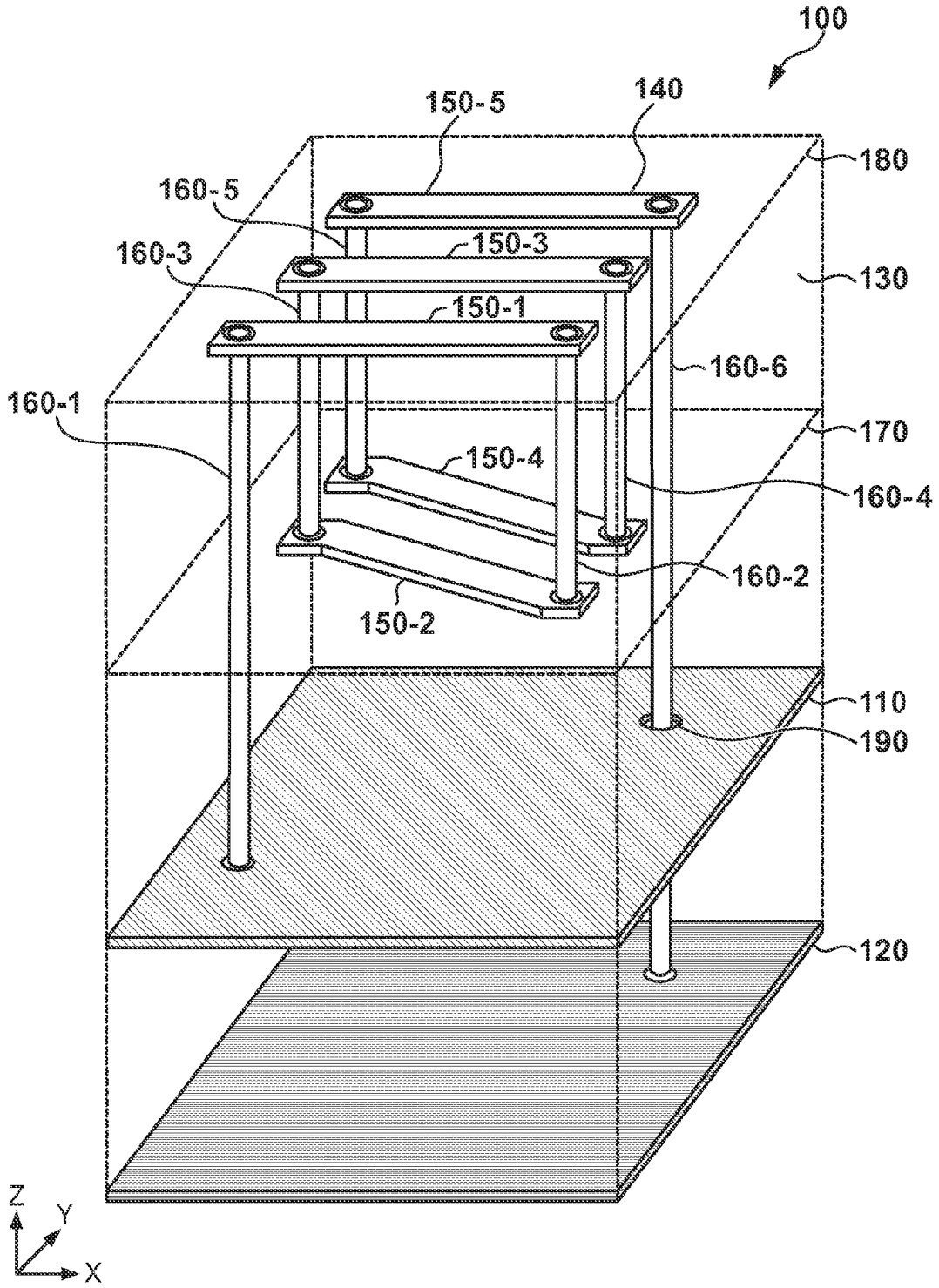
FIG. 8 is a three-dimensional perspective view of a metamaterial cell according to still another modification of the first embodiment.

In addition, as shown in FIG. 7, the conductor lines 150-2 and 150-4 can also be formed on a plane 180 different from the patch conductor 110. In this case, the clearance for containing the connection conductor can be excluded from the patch conductor 110. Also, the planes 170 and 180 can be formed not between the patch conductor 110 and conductor layer 120, but above the patch conductor 110 as shown in FIG. 8, or below the conductor layer 120 although not shown. Note that in the arrangement shown in FIG. 8, a hole 190 must be formed in the patch conductor 110 so as to prevent an electrical connection between a via 160-6 and the patch conductor 110.

Furthermore, the clearance formed in each of the patch conductor 110 and conductor layer 120 according to this embodiment is a square in the drawings, but the shape of the clearance is not limited to this, and any shape can be used as long as an electrical connection to the contained conductor lines can be avoided. To decrease the frequency, the area of the clearance is desirably decreased as much as possible, for example, a shape formed along the contour of the conductor line is desirable, because the parallel capacitor component increases. Also, the patch conductor 110 according to this embodiment is a square in the drawings, but the shape is not limited to this and may also be a polygon (triangle or hexagon) or a circle.

Second Embodiment

In the first embodiment, the metamaterial that increases the inductance of the connection conductor by forming it by connecting the vias and conductor lines in series into a helical type shape has been explained. Normally, a land (to be referred to as a via land hereinafter) is formed around the opening of a via. Although the size of the via land is not taken into consideration in the first embodiment, the minimum diameter of the via land is generally larger than the minimum line width of the conductor line and the minimum pitch between the conductor lines. Therefore, when increasing the density by closely arranging the conductor lines in the electromagnetic bandgap structure according to the first embodiment, the minimum diameter of the via land restricts the density.

Figure 9:
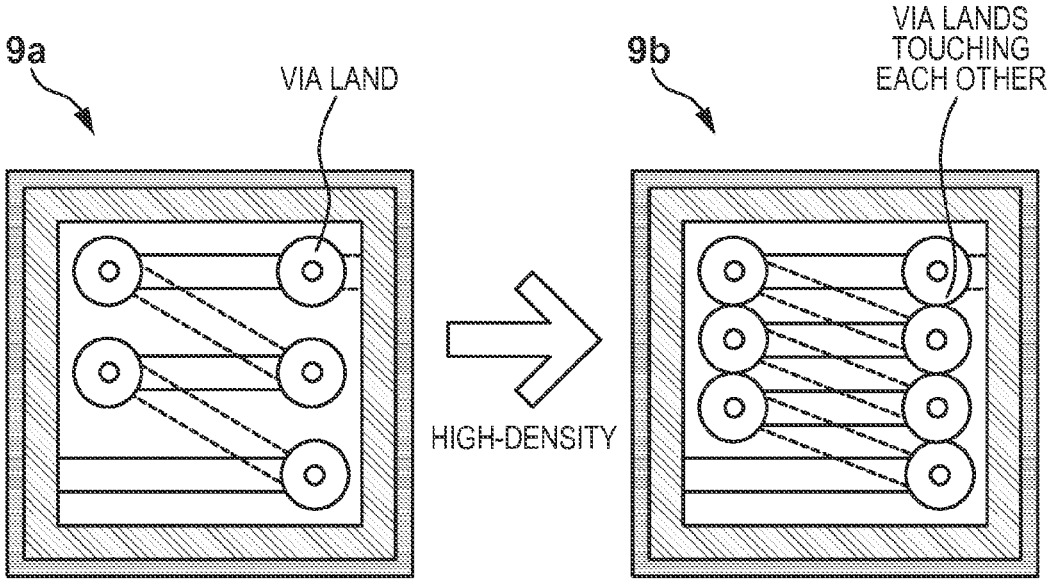
FIG. 9 is a view for explaining the problem of the metamaterial according to the first embodiment.

This problem restricting the density will be explained with reference to FIG. 9. In FIG. 9, 9*a* is a plan view of the metamaterial cell explained in the first embodiment. In 9*a* of FIG. 9, the via land has the minimum diameter, and the conductor line has the minimum line width. Assume that in 9*a*, two conductor lines and two vias are added by arranging the conductor lines more closely, in order to increase the inductance of the connection conductor. As shown in 9*b* in of FIG. 9, then, the via lands are electrically in touch with each other, and the connection conductor no longer has a helical type shape. Consequently, the inductance of the connection conductor becomes smaller than that shown in 9*a* of FIG. 9. This embodiment has been made in consideration of this problem, and a metamaterial that efficiently increases the inductance of the connection conductor while taking account of the size of the via land will be explained.

Figure 10:
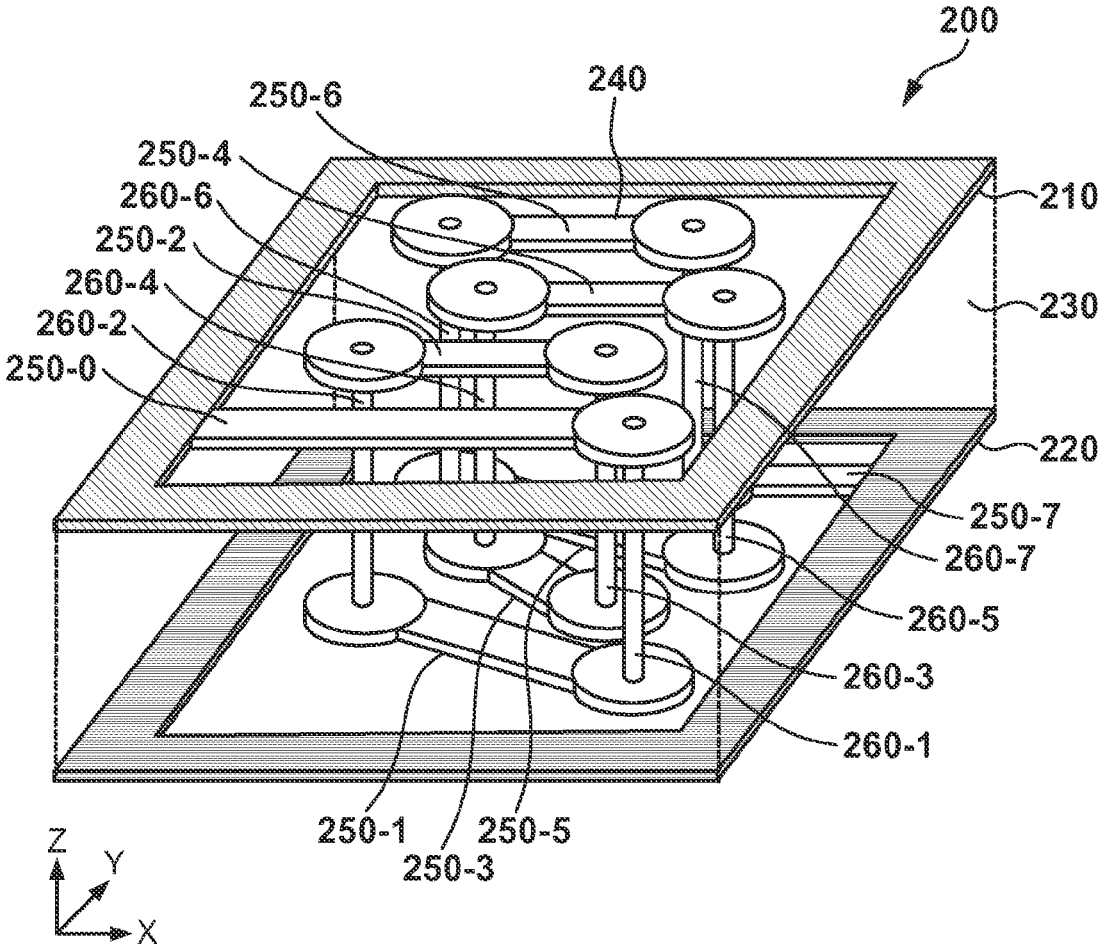
FIG. 10 is a three-dimensional perspective view of a metamaterial cell according to the second embodiment.
Figure 11:
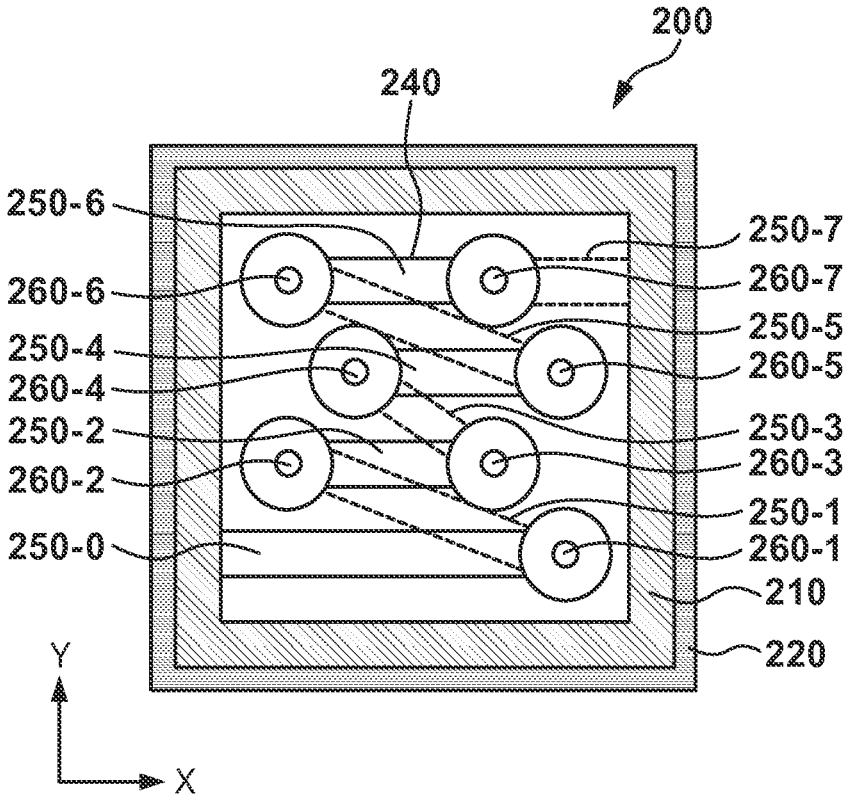
FIG. 11 is a plan view of the cell shown in FIG. 10.

FIG. 10 is a three-dimensional perspective view of a metamaterial cell according to an embodiment of the present invention. FIG. 11 is a plan view of the cell shown in FIG. 10. The array structure of the metamaterial is a structure in which the cells are two-dimensionally arranged as shown in FIG. 3 of the first embodiment, and hence is not shown.

A cell 200 includes a patch conductor 210, a conductor layer 220, a dielectric layer 230, and a connection conductor 240 obtained by connecting conductor lines 250-0 to 250-7 and vias 260-1 to 260-7 in series. The via 260-1 is connected to the patch conductor 210 via the conductor line 250-0, and connected to the via 260-2 via the conductor line 250-1. Analogously, the vias 260-2 to 260-6 are respectively connected to the vias 260-3 to 260-7 via the conductor lines 250-2 to 250-6. The via 260-7 is connected to the conductor layer 220 via the conductor line 250-7.

The conductor lines 250-0, 250-2, 250-4, and 250-6 are arranged on the same plane as that of the patch conductor 210, and the patch conductor 210 has a clearance for containing the conductor lines 250-0, 250-2, 250-4, and 250-6. Also, the conductor lines 250-1, 250-3, 250-5, and 250-7 are arranged on the same plane as that of the conductor layer 220, and the conductor layer 220 has a clearance for containing the conductor lines 250-1, 250-3, 250-5, and 250-7.

In this embodiment, the conductor lines 250-0, 250-2, 250-4, and 250-6 are arranged parallel and close to each other, and adjacent conductor lines are arranged in a zigzag direction, that is, staggered while maintaining the parallelism as shown in FIG. 11. This arrangement makes it possible to increase the distance between adjacent via lands. When compared to the first embodiment, therefore, it is possible to closely arrange the conductor lines, and efficiently increase the inductance of the connection conductor in a narrow space. Note that FIGS. 10 and 11 illustrate an example in which the conductor lines on the patch conductor 210 are arranged in a zigzag direction, but the conductor lines on the conductor layer 220 may be arranged in a zigzag direction instead.

Figure 12:
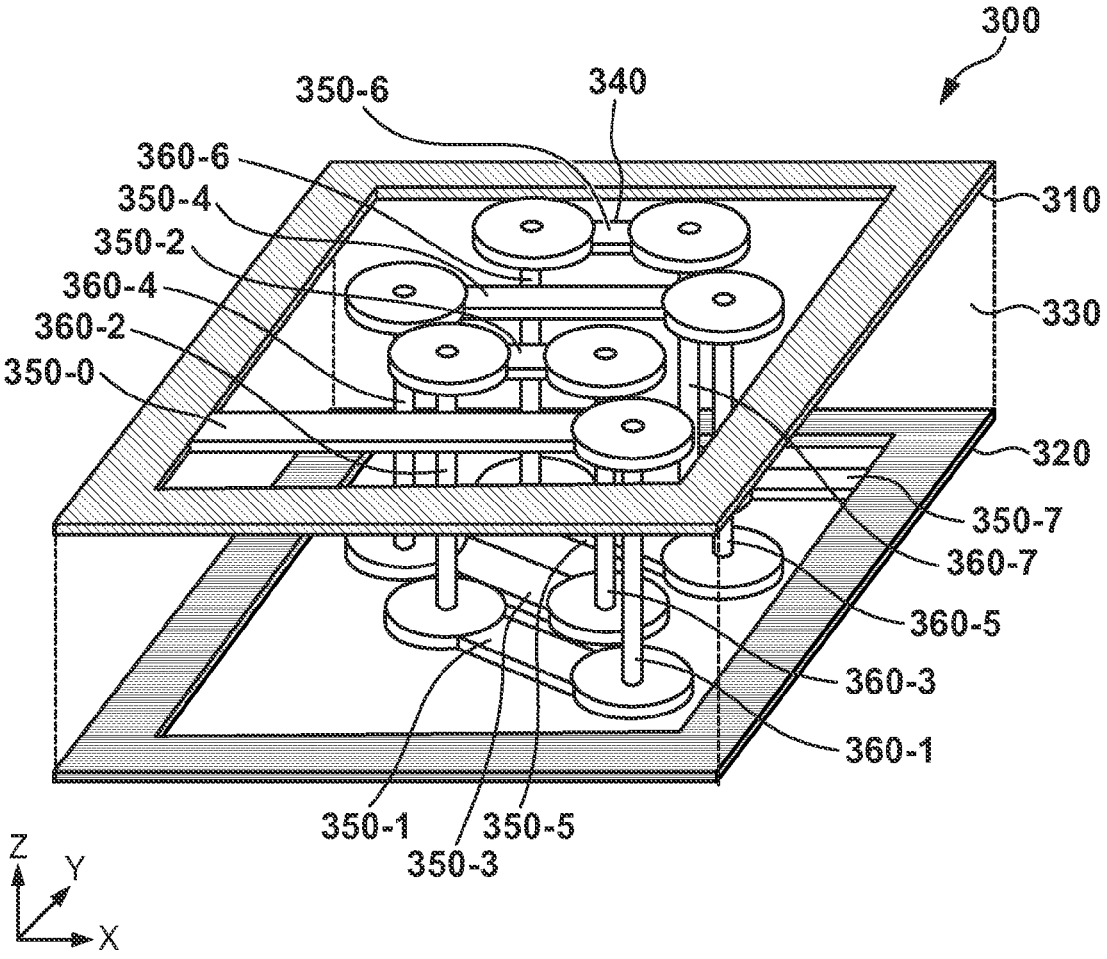
FIG. 12 is a three-dimensional perspective view of a metamaterial cell according to a modification of the second embodiment.
Figure 13:
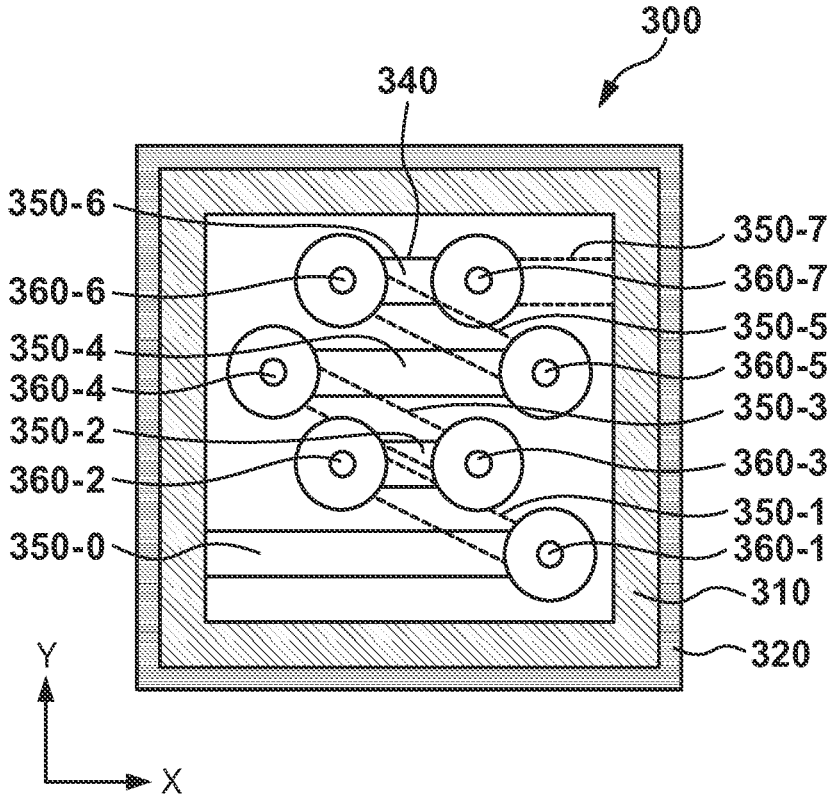
FIG. 13 is a plan view of the cell shown in FIG. 12.

FIG. 12 is a three-dimensional perspective view of a metamaterial cell according to a modification of this embodiment. FIG. 13 is a plan view of the cell shown in FIG. 12. The array structure of the metamaterial is a structure in which the cells are two-dimensionally arranged as shown in FIG. 3 of the first embodiment, and hence is not shown. A cell 300 includes a patch conductor 310, a conductor layer 320, a dielectric layer 330, and a connection conductor 340 obtained by connecting conductor lines 350-0 to 350-7 and vias 360-1 to 360-7 in series.

The via 360-1 is connected to the patch conductor 310 via the conductor line 350-0, and connected to the via 360-2 via the conductor line 350-1. Similarly, the vias 360-2 to 360-6 are respectively connected to the vias 360-3 to 360-7 via the conductor lines 350-2 to 350-6. The via 360-7 is connected to the conductor layer 320 via the conductor line 350-7.

In this embodiment, the conductor lines 350-0, 350-2, 350-4, and 350-6 are arranged on the same plane as that of the patch conductor 310, and the patch conductor 310 has a clearance for containing the conductor lines 350-0, 350-2, 350-4, and 350-6. Also, the conductor lines 350-1, 350-3, 350-5, and 350-7 are arranged on the same plane as that of the conductor layer 320, and the conductor layer 320 has a clearance for containing the conductor lines 350-1, 350-3, 350-5, and 350-7.

The conductor lines 350-0, 350-2, 350-4, and 350-6 are arranged parallel and close to each other, and adjacent conductor lines are arranged such that long and short lines are alternately arranged, as shown in FIG. 13. This arrangement makes it possible to increase the distance between adjacent via lands. When compared to the first embodiment, therefore, it is possible to closely arrange the conductor lines, and efficiently increase the inductance of the connection conductor in a narrow space. Note that FIGS. 12 and 13 illustrate an example in which the lengths of the conductor lines on the patch conductor 310 are changed, but the lengths of the conductor lines on the conductor layer 320 may be changed instead.

Figure 14:
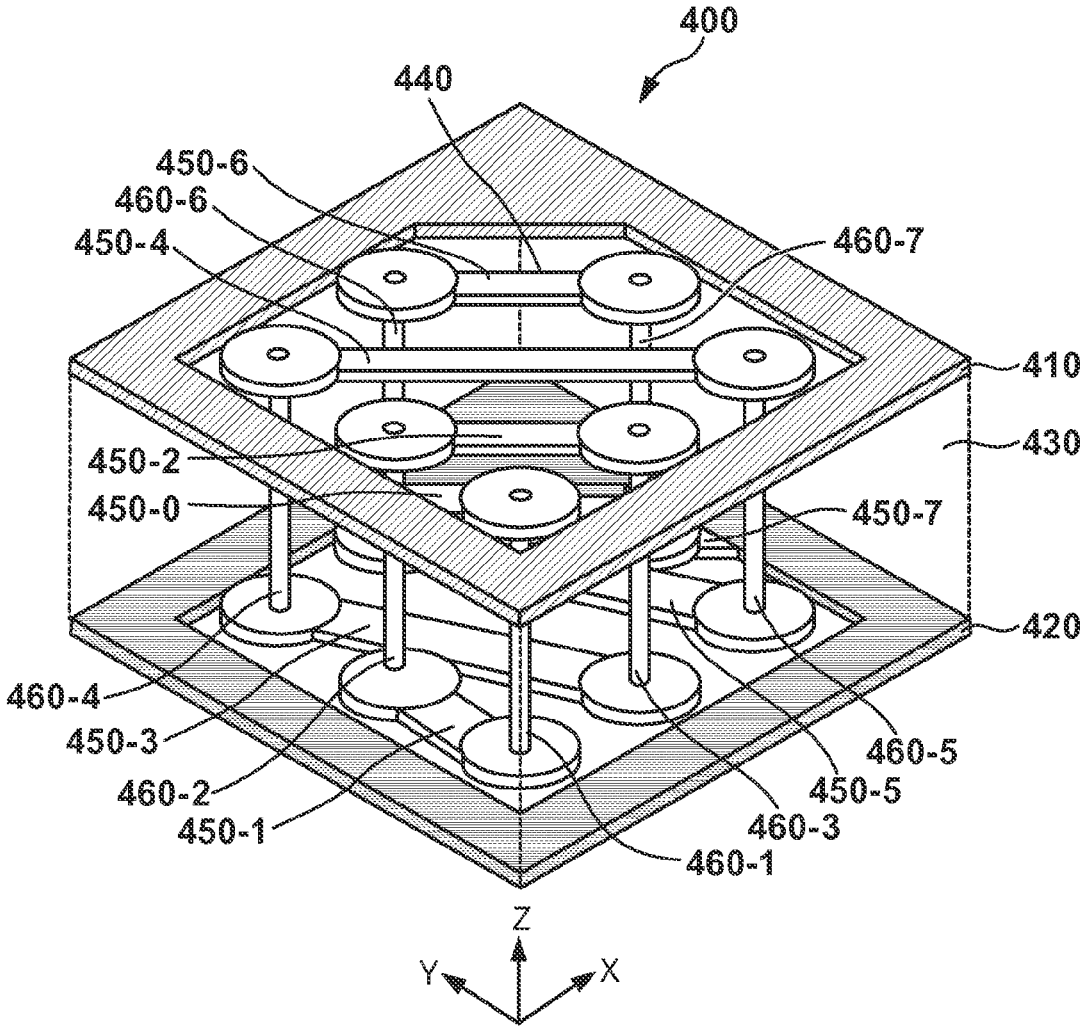
FIG. 14 is a three-dimensional perspective view of a metamaterial cell according to another modification of the second embodiment.
Figure 15:
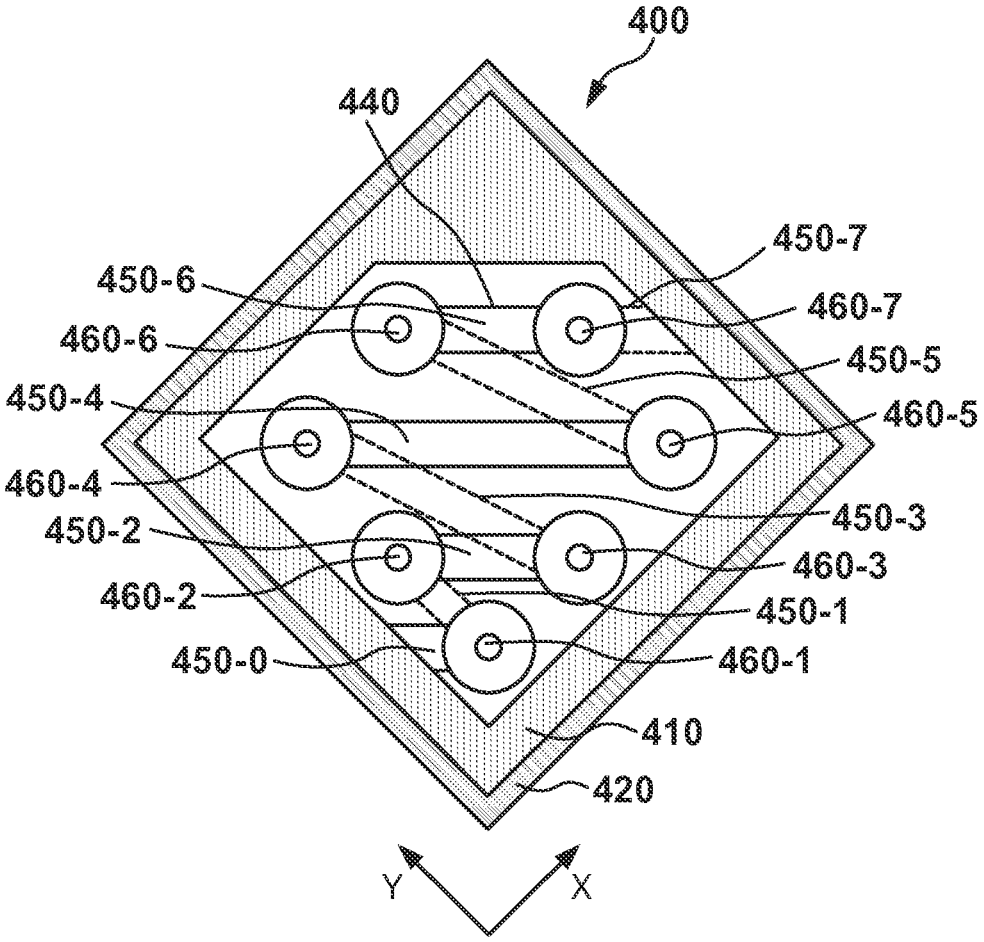
FIG. 15 is a plan view of the cell shown in FIG. 14.

FIG. 14 is a three-dimensional perspective view of a metamaterial cell according to another modification of this embodiment. FIG. 15 is a plan view of the cell shown in FIG. 14. The array structure of the metamaterial is a structure in which the cells are two-dimensionally arranged as shown in FIG. 3 of the first embodiment, and hence is not shown. A cell 400 includes a patch conductor 410, a conductor layer 420, a dielectric layer 430, and a connection conductor 440 obtained by connecting conductor lines 450-0 to 450-7 and vias 460-1 to 460-7 in series.

The via 460-1 is connected to the patch conductor 410 via the conductor line 450-0, and connected to the via 460-2 via the conductor line 450-1. Likewise, the vias 460-2 to 460-6 are respectively connected to the vias 460-3 to 460-7 via the conductor lines 450-2 to 450-6. The via 460-7 is connected to the conductor layer 420 via the conductor line 450-7.

In this embodiment, the conductor lines 450-0, 450-2, 450-4, and 450-6 are arranged on the same plane as that of the patch conductor 410, and the patch conductor 410 has a clearance for containing the conductor lines 450-0, 450-2, 450-4, and 450-6. Also, the conductor lines 450-1, 450-3, 450-5, and 450-7 are arranged on the same plane as that of the conductor layer 420, and the conductor layer 420 has a clearance for containing the conductor lines 450-1, 450-3, 450-5, and 450-7.

The conductor lines 450-0, 450-2, 450-4, and 450-6 are arranged parallel and adjacent to each other, and each conductor line is arranged parallel to the diagonal line of the patch conductor, as shown in FIG. 15. This arrangement makes it possible to increase the distance between adjacent via lands. When compared to the first embodiment, therefore, it is possible to adjacently arrange the conductor lines, and efficiently increase the inductance of the connection conductor in a narrow space. Note that FIGS. 14 and 15 illustrate an example in which the conductor lines on the patch conductor 410 are arranged parallel to the diagonal line of the patch conductor, but the conductor lines on the conductor layer 420 may be arranged parallel to the diagonal line of the conductor layer instead.

Figure 16:
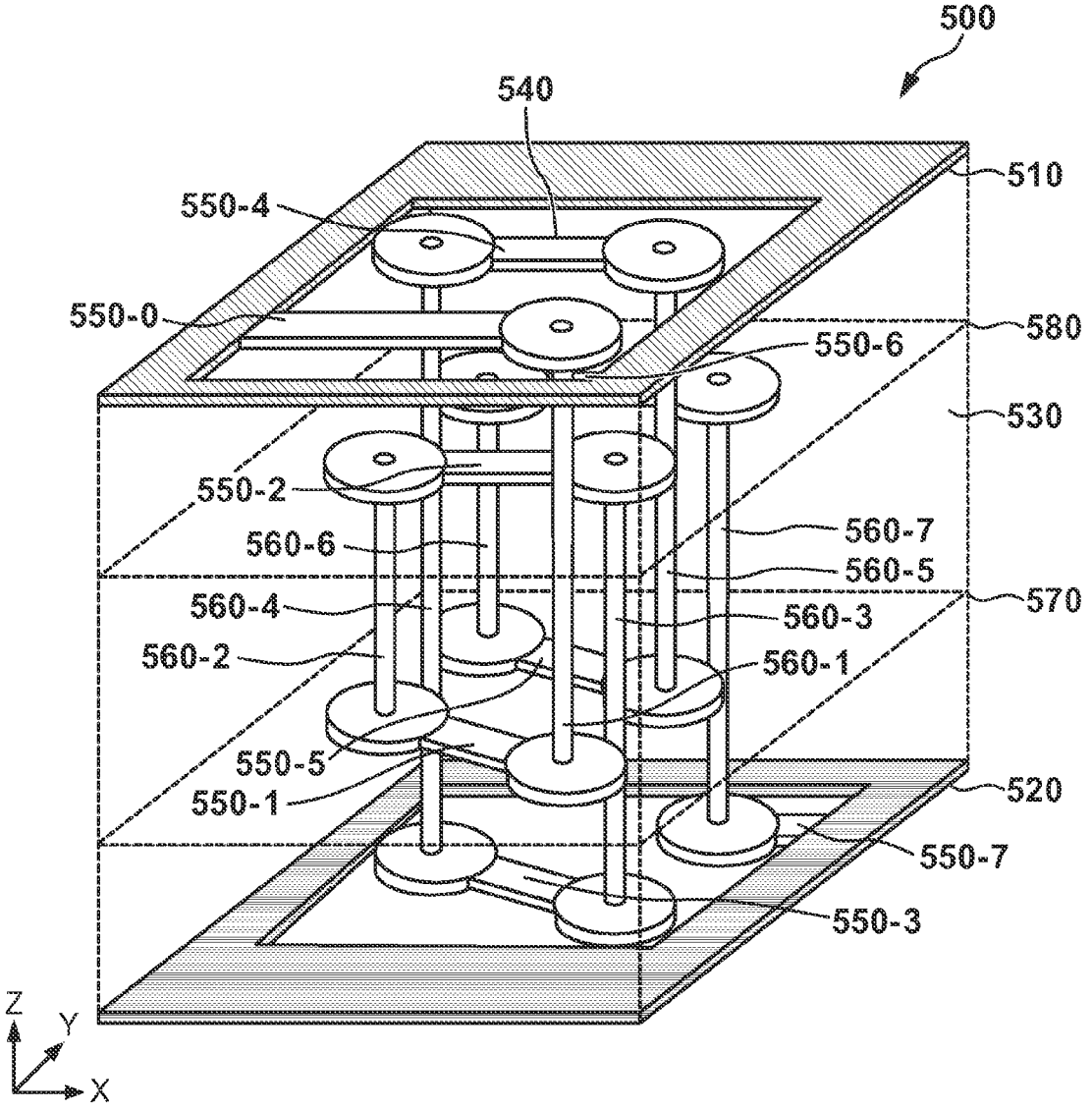
FIG. 16 is a three-dimensional perspective view of a metamaterial cell according to still another modification of the second embodiment.
Figure 17:
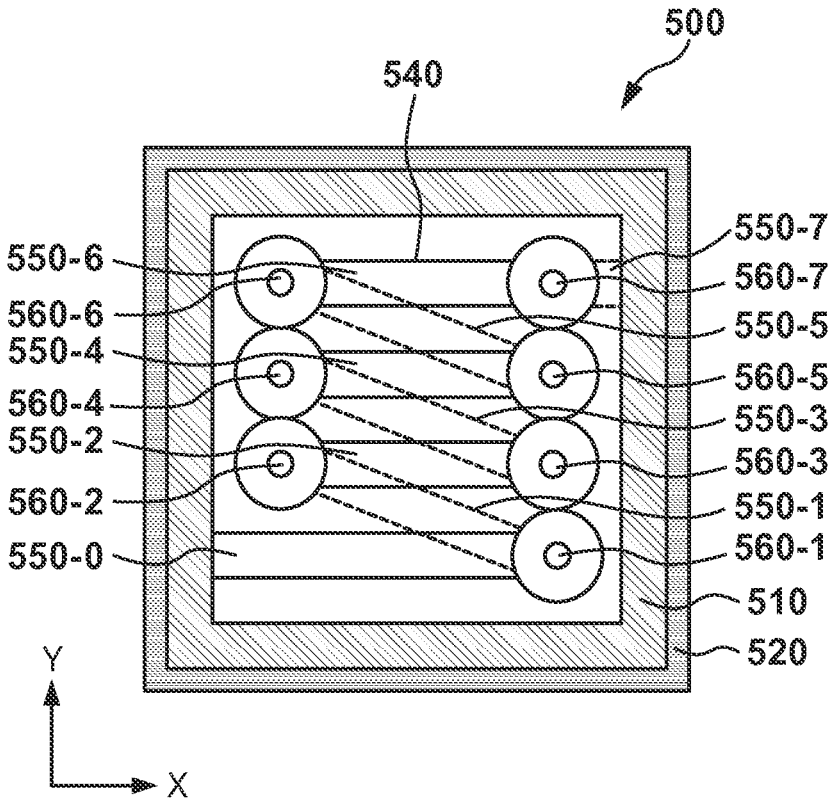
FIG. 17 is a plan view of the cell shown in FIG. 16.

FIG. 16 is a three-dimensional perspective view of a metamaterial cell according to still another modification of this embodiment. FIG. 17 is a plan view of the cell shown in FIG. 16. The array structure of the metamaterial is a structure in which the cells are two-dimensionally arranged as shown in FIG. 3 of the first embodiment, and hence is not shown. A cell 500 includes a patch conductor 510, a conductor layer 520, a dielectric layer 530, and a connection conductor 540 obtained by connecting conductor lines 550-0 to 550-7 and vias 560-1 to 560-7 in series.

The via 560-1 is connected to the patch conductor 510 via the conductor line 550-0, and connected to the via 560-2 via the conductor line 550-1. Similarly, the vias 560-2 to 560-6 are respectively connected to the vias 560-3 to 560-7 via the conductor lines 550-2 to 550-6. The via 560-7 is connected to the conductor layer 520 via the conductor line 550-7.

In this embodiment, the conductor lines 550-0 and 550-4 are arranged on the same plane as that of the patch conductor 510, and the patch conductor 510 has a clearance for containing the conductor lines 550-0 and 550-4. Also, the conductor lines 550-3 and 550-7 are arranged on the same plane as that of the conductor layer 520, and the conductor layer 520 has a clearance for containing the conductor lines 550-3 and 550-7. Furthermore, the conductor lines 550-2 and 550-6 are arranged on a plane 580, and the conductor lines 550-1 and 550-5 are arranged on a plane 570. That is, adjacent conductor lines are alternately arranged in different layers.

Figure 18:
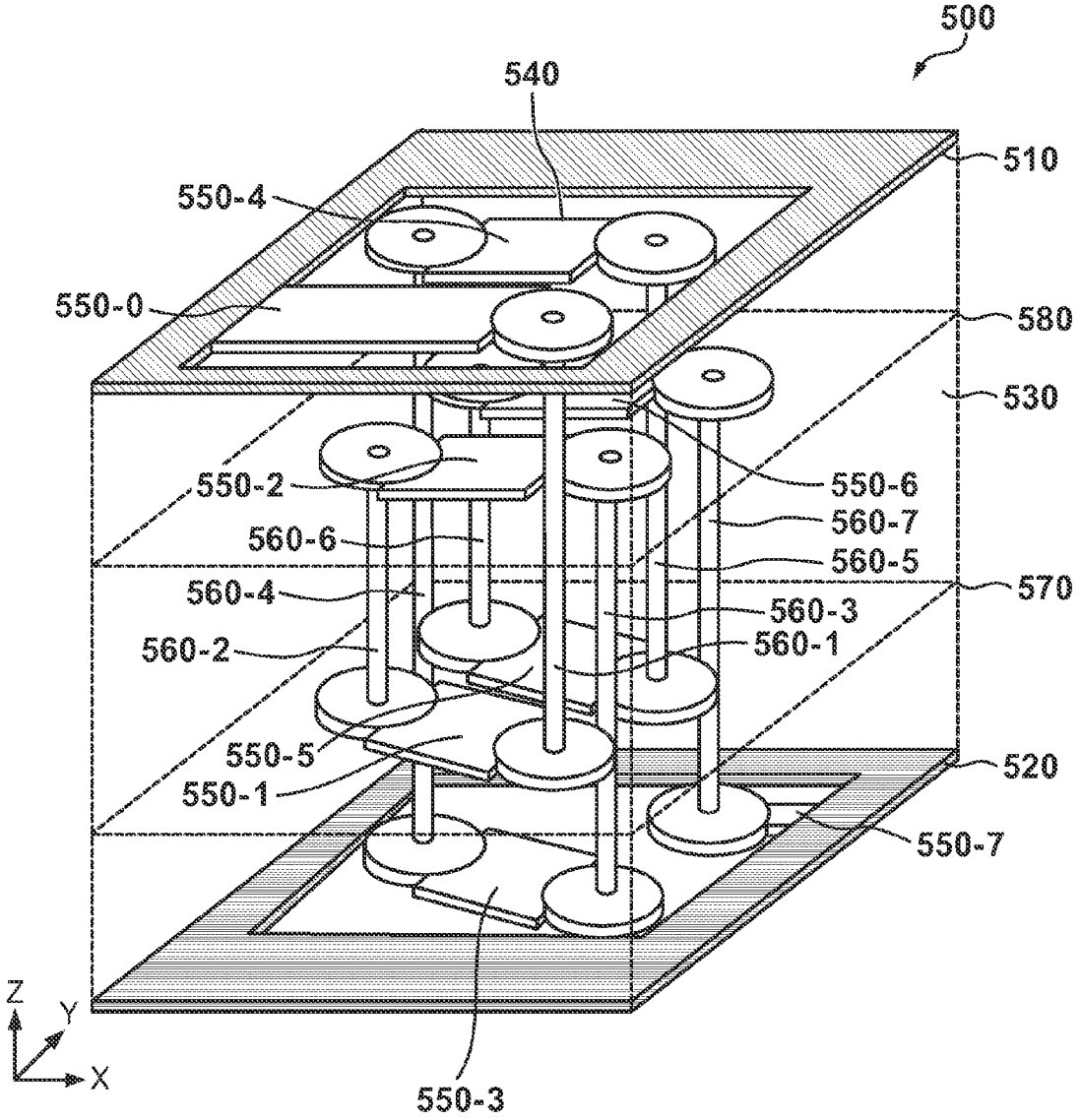
FIG. 18 is a three-dimensional perspective view of a metamaterial cell according to still another modification of the second embodiment.

This arrangement makes it possible to increase the distance between via lands on the same plane. When compared to the first embodiment, therefore, it is possible to adjacently arrange the conductor lines, and efficiently increase the inductance of the connection conductor in a narrow space. Also, as shown in FIG. 18, when the line width of the conductor line is increased to such an extent that conductor lines adjacent to each other on the same plane are not electrically in touch with each other, it is possible to increase a capacitor generated between connection conductors adjacent to each other on the same plane, and a capacitor generated between connection conductors adjacent to each other on different planes. Since this contributes to the increase in parallel capacitor CR, a low-frequency-band electromagnetic bandgap can be achieved by a smaller cell.

By thus forming the connection conductors to have the shapes as indicated by 240 in FIG. 10, 340 in FIG. 12, 440 in FIG. 14, and 540 in FIG. 16, the inductance of the connection conductor can efficiently be increased while taking account of the size of the via land.

Note that the eight conductor lines and seven vias are connected in series in the connection conductors 240, 340, 440, and 540 according to this embodiment, but their numbers are not limited to these numbers as described in the first embodiment. Note also that the clearances are formed in the patch conductor and conductor layer and the connection conductor is contained in these clearances in this embodiment, but the present invention is not limited to this arrangement as in the first embodiment. That is, the connection conductor may also be arranged on a plane different from the patch conductor or conductor layer, or on planes different from both of them. In this case, it is possible to exclude the clearance for containing the connection conductor from one or both of the patch conductor and conductor layer.

Third Embodiment

In each of the first and second embodiments, the array structure of the metamaterial cells has been explained as a structure in which all the cells are arranged such that their connection conductors are arranged in the same direction. For example, in the array structure 1000 of the metamaterial cells of the first embodiment shown in FIG. 3, the conductor lines 150-0, 150-2, and 150-4 of all the cells are arranged parallel to the x-axis. In this structure, however, the mutual inductance generated between adjacent connection conductors in the x-axis direction is different from that in the y-axis direction.

For example, it is obvious from equation (1) that the mutual inductance generated between the connection conductors in the cells 100A and 100B shown in FIG. 3 differs from that generated between the connection conductors in the cells 100A and 100C. In the metamaterial cell array structure 1000, therefore, the electromagnetic bandgap has different anisotropies on the x-axis and y-axis. However, the anisotropy is desirably small in order to improve the convenience when the electromagnetic bandgap structure is applied to a band-stop filter or the like. In this embodiment, a metamaterial having a small anisotropy will be explained by taking account of the above problem. This embodiment will be explained by taking the cell 100 explained in the first embodiment as an example.

Figure 19:
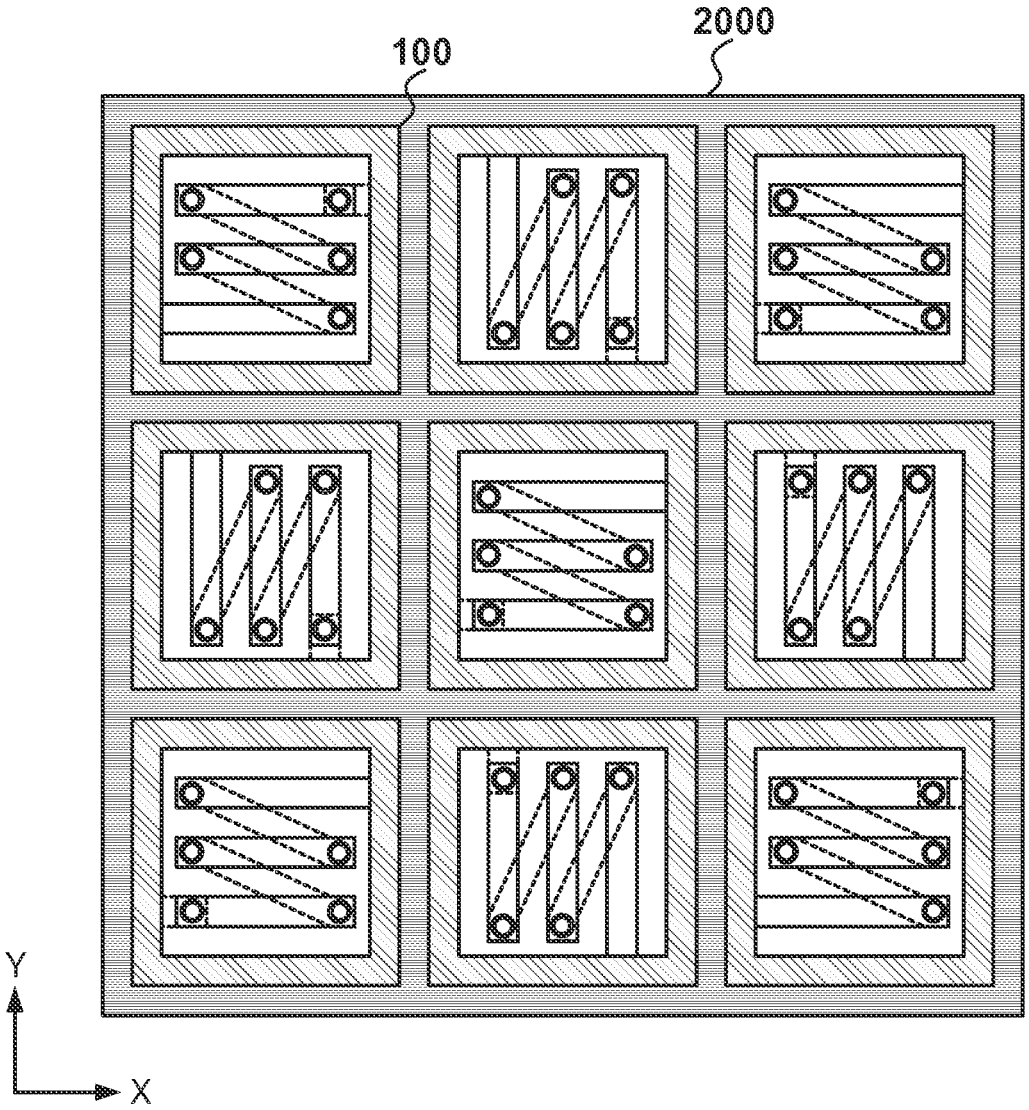
FIG. 19 is a view showing the array structure of metamaterial cells according to the third embodiment.

FIG. 19 shows a metamaterial cell array structure 2000 in which the cells 100 are arranged to decrease the anisotropy. In the metamaterial cell array structure 2000 as shown in FIG. 19, the connection conductors of adjacent cells are arranged such that they are rotated 90° to each other around the z-axis as a rotational axis. In this arrangement, the difference between the mutual inductance generated between two connection conductors in the x-axis direction and the mutual inductance generated between two connection conductors in y-axis direction is smaller than that in the metamaterial cell array structure 1000 shown in FIG. 3. A metamaterial having a small anisotropy can be realized by thus arranging the metamaterial cells.

Note that this embodiment has been explained by taking the cell 100 according to the first embodiment as an example, but the embodiment is not limited to this. That is, an electromagnetic bandgap structure having a small anisotropy can be realized by using the same structure for the cell structures (for example, the cells 200, 300, 400, and 500 of the second embodiment) included in the present invention.

Note also that the metamaterial of the present invention has an electromagnetic bandgap in the above explanation, but the metamaterial is not limited to this. An example is a 0th-order resonance mode antenna having no electromagnetic bandgap. That is, any metamaterial including the cells of the present invention is included in the scope of the invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-211533, filed Sep. 25, 2012, which is hereby incorporated by reference herein in its entirety.

The invention claimed is:

1. A cell forming a metamaterial, comprising a patch conductor, a conductor layer which forms a ground layer or a power supply layer, arranged in parallel with the patch conductor, and a connection conductor configured to electrically connect the patch conductor and the conductor layer, wherein the connection conductor forms a helical electrical path by a plurality of conductor lines and a plurality of vias which connect the conductor lines to the patch conductor and the conductor layer, and wherein an electrical path is formed so that current directions in the conductor lines on a same plane are a predetermined direction.

2. The cell according to claim 1, wherein the connection conductor includes at least first to Nth vias (N is an integer of not less than 3), and at least first to (N−1)th conductor lines, the first via is directly connected to the patch conductor, the Nth via is directly connected to the conductor layer, and a Kth via (K is an integer of 1 to N−1) is connected to a (K+1)th via via a Kth conductor line.

3. The cell according to claim 1, wherein the connection conductor includes at least first to Nth vias (N is an integer of not less than 3), and at least first to (N+1)th conductor lines, the first via is connected to the patch conductor via the first conductor line, the Nth via is connected to the conductor layer via the (N+1)th conductor line, and a Kth via (K is any integer from 1 to N−1) is connected to a (K+1)th via via a (K+1)th conductor line.

4. The cell according to claim 1, wherein the conductor lines are alternately arranged on a same plane of the patch conductor and a same plane of the conductor layer via the vias.

5. The cell according to claim 1, wherein another plane is further defined in addition to the patch conductor and the conductor layer, and the conductor lines are alternately arranged via vias on a plane of one of the patch conductor and the conductor layer and on the other plane.

6. The cell according to claim 1, wherein two other planes are further defined in addition to planes of the patch conductor and the conductor layer, and the conductor lines are alternately arranged via vias on the two other planes.

7. The cell according to claim 4, wherein conductor lines arranged on one of different planes are arranged in a zigzag direction.

8. The cell according to claim 4, wherein conductor lines arranged on one of different planes are arranged such that lengths are different.

9. The cell according to claim 4, wherein conductor lines arranged on one of different planes are arranged parallel to a diagonal line of the plane of one of the patch conductor and the conductor layer.

10. The cell according to claim 4, wherein in a case where the conductor lines are arranged on the planes of the patch conductor and the conductor layer, the patch conductor and the conductor layer each comprise a clearance for containing the conductor lines.

11. An array structure in which cells cited in claim 1 are arranged such that connection conductors of two adjacent patch conductors are arranged in the same direction.

12. An array structure in which cells cited in claim 1 are arranged such that connection conductors of two adjacent patch conductors are rotated 90° to each other.

* * * * *